US011851958B2

(12) United States Patent
Quero et al.

(10) Patent No.: US 11,851,958 B2
(45) Date of Patent: Dec. 26, 2023

(54) SUPPORT STRUCTURE FOR GUIDE ARCH

(71) Applicant: HALLIBURTON ENERGY SERVICES, INC., Houston, TX (US)

(72) Inventors: Philippe Quero, Houston, TX (US); Eric Bivens, Littleton, CO (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 548 days.

(21) Appl. No.: 17/047,758

(22) PCT Filed: Dec. 4, 2019

(86) PCT No.: PCT/US2019/064518
§ 371 (c)(1),
(2) Date: Oct. 15, 2020

(87) PCT Pub. No.: WO2021/112844
PCT Pub. Date: Jun. 10, 2021

(65) Prior Publication Data

US 2023/0151703 A1 May 18, 2023

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS

| | | | | |
|---|---|---|---|---|
| 5,799,731 | A * | 9/1998 | Avakov | E21B 19/22 166/85.5 |
| 6,006,839 | A * | 12/1999 | Dearing | E21B 19/22 166/85.5 |
| 7,036,578 | B2 * | 5/2006 | Austbo | E21B 19/22 226/173 |
| 9,759,022 | B2 * | 9/2017 | Andreychuk | E21B 7/023 |
| 2007/0209791 | A1 | 9/2007 | Havinga | |
| 2008/0023227 | A1 | 1/2008 | Patton | |
| 2009/0223677 | A1 * | 9/2009 | Dreelan | E21B 19/22 242/615 |
| 2015/0101799 | A1 * | 4/2015 | Steffenhagen | E21B 17/20 166/250.01 |
| 2018/0354742 | A1 | 12/2018 | Cooper et al. | |
| 2019/0085647 | A1 * | 3/2019 | Gubbins | E21B 19/22 |

FOREIGN PATENT DOCUMENTS

CN 102287151 A * 12/2011

OTHER PUBLICATIONS

International Search Report and Written Opinion of PCT/US2019/064518 dated Aug. 31, 2020.

* cited by examiner

*Primary Examiner* — Matthew R Buck
(74) *Attorney, Agent, or Firm* — NOVAK DRUCE CARROLL LLP

(57) ABSTRACT

A pivoting guide arch is provided. The guide arch includes a guide having a curved portion to receive a coiled tube and to guide the tube as the tube traverses between a reel and a wellbore. The guide arch also includes a support structure extending from a first end of the guide that is configured to mechanically support the guide, and a swivel mount that is rotatably coupled to a wellhead to enable the guide and support structure to pivot about an axis of the wellhead.

20 Claims, 6 Drawing Sheets

SUPPORT STRUCTURE FOR GUIDE ARCH

CROSS-REFERENCE TO RELATED APPLICATIONS

This application is a national stage entry of PCT/US2019/064518 filed Dec. 4, 2019, said application is expressly incorporated herein by reference in its entirety.

TECHNICAL FIELD

The present disclosure relates generally to guide arches used in wellhead systems. In at least one example, the present disclosure relates to a pivoting and supported guide arch.

BACKGROUND

Wellbores are drilled into the earth for a variety of purposes including accessing hydrocarbon bearing formations. In conventional wells for the production of hydrocarbons, one or more cylindrical casings surround a smaller diameter production tubing through which the hydrocarbons will flow to the wellhead. Production tubing may utilize continuous tubing that is stored on a reel and installed or removed from the well using an injector. To guide the tubing from the reel and into the well, from a roughly horizontal or upwardly sloping direction as the tubing comes off the reel to a vertical direction required for downhole injection, a guide arch may be utilized.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
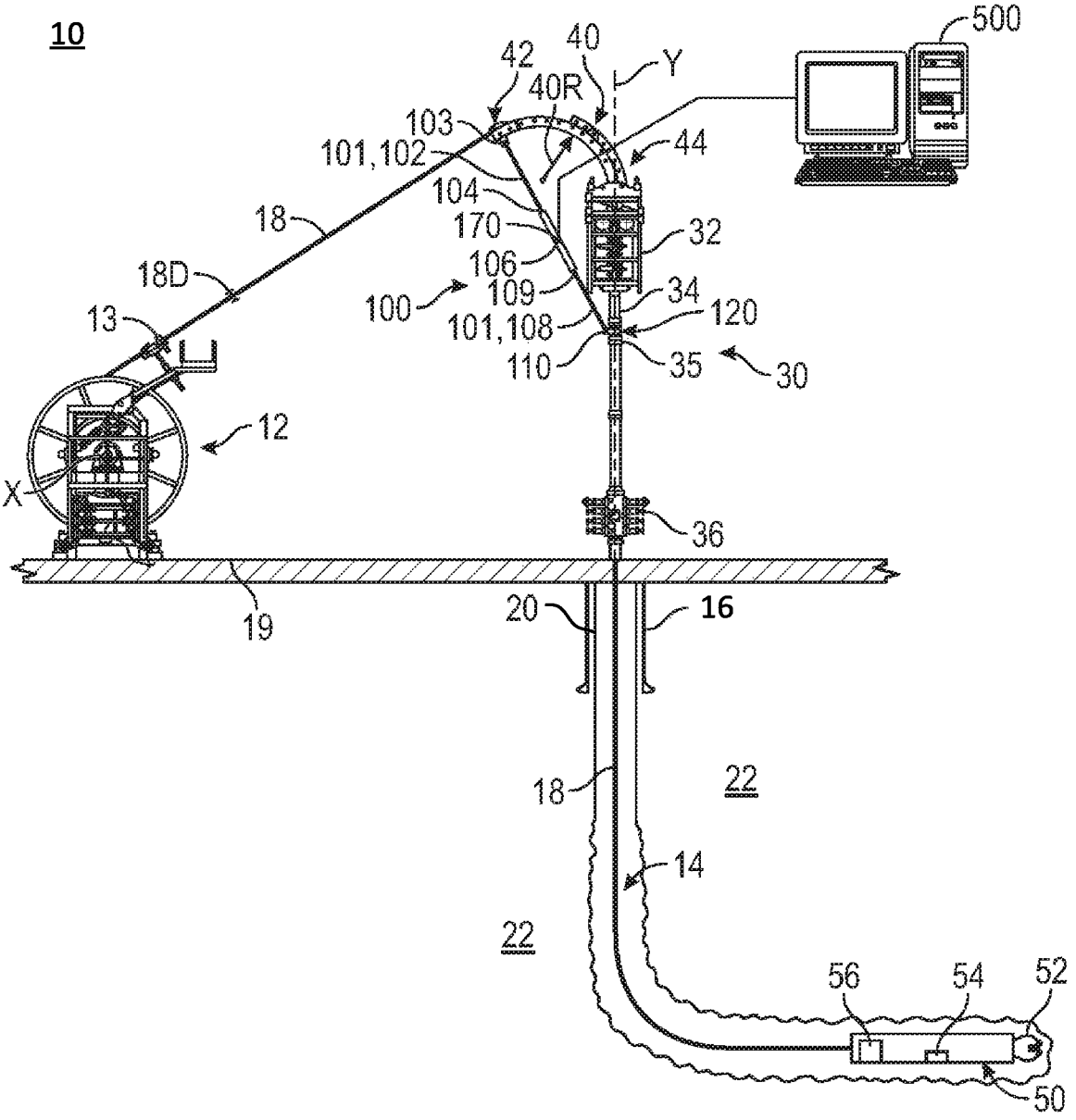
FIG. 1 is a diagram illustrating an exemplary environment for a wellhead utilizing a guide arch with an articulating support structure, in accordance with various aspects of the subject technology.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, not all of the details may be necessary to practice the disclosed examples. In other instances, methods, procedures and components have been described so as not to obscure the related relevant feature being described. Also, the description is not to be considered as limiting the scope of the examples described herein. The drawings are not necessarily to scale and the proportions of certain parts may be exaggerated to better illustrate details and features.

Disclosed herein is a pivoting guide arch coupled to a wellhead. The pivoting guide arch includes a guide having a curved portion. The guide receives a conduit, such as coiled tubing, and guides the conduit along the curved portion into the wellhead, and subsequently into a wellbore. The guide is rotatably coupled to the wellhead such that the guide pivots about the axis of the wellhead. A support structure extends from the first end of the guide and mechanically supports the guide. The support structure provides support to the guide such that the guide can receive coiled tubing with a larger diameter, for example 2 inches. As the coiled tubing increases is size, the weight of the coiled tubing also increases. Accordingly, the support structure provides support to the guide to accommodate larger, heavier, coiled tubing.

A swivel mount is coupled to an end of the support structure opposite the guide and is rotatably coupled to the wellhead. Accordingly, the support structure can pivot about an axis of the wellhead along with the guide while also providing mechanical support to the guide.

FIG. 1 is a diagram illustrating an exemplary environment 10 for a wellhead 30 utilizing a guide arch 40 with an articulating support structure 100, in accordance with various aspects of the subject technology. The exemplary environment 10 includes a wellhead 30 disposed on a surface 19 extending over and around a wellbore 14. The wellbore 14 is within an earth formation 22 and, in at least one example, can have a casing 20 lining the wellbore 14. The casing 20 can be held into place by cement 16. In at least one example, the conduit 18 can be at least partially made of an electrically conductive material, for example steel. In another example, the conduit 18 can be at least partially made of a non-electrically conductive material, for example fiberglass or PEEK, or of a low-conductivity material, for example carbon composite, or a combination of such materials. A downhole tool 50 can be disposed within the wellbore 14 and moved down the wellbore 14 via a conduit 18 to a desired location. The conduit 18 may be coiled tubing. In other examples, the conduit 18 can be, for example, tubing-conveyed via a wireline, slickline, work string, joint tubing, jointed pipe, pipeline, and/or any other suitable means. The downhole tool 50 can include, for example, downhole sensors, chokes, and valves. The chokes and valves may include actuatable flow regulation devices, such as variable chokes and valves, and may be used to regulate the flow of the fluids into and/or out of the conduit 18. The downhole tool 50 also includes a drill tool 52 to drill the wellbore 14 in the formation 22. For example, the drill tool 52 can include a drill bit, a mill, and/or an auger. One or more assembly sensors 54 can be disposed in the downhole tool 50 and provide measurements and data of the wellbore 14, the formation 22, and/or the downhole tool 50. For example, the assembly sensors 54 can include a directional sensor which can determine the direction that the downhole tool 50 is drilling in the formation 22. In some examples, as illustrated in FIG. 1, the downhole tool 50 can include a power source 56. The power source 56 can provide power to the components of the downhole tool 50, for example the assembly sensors 54 and/or a motor to actuate the drill tool 52.

It should be noted that while FIG. 1 generally depicts a land-based operation, those skilled in the art would readily recognize that the principles described herein are equally applicable to operations that employ floating or sea-based platforms and rigs, without departing from the scope of the disclosure. Also, even though FIG. 1 depicts a vertical wellbore, the present disclosure is equally well-suited for use in wellbores having other orientations, including horizontal wellbores, slanted wellbores, multilateral wellbores or the like.

The wellhead 30 can include a blowout preventer 36, a stripper 34, and/or an injector 32. The injector 32 can inject the conduit 18 into the wellbore 14. For example, the conduit 18 can be stored in a reel 12 and when dispatched, may extend from the reel 12, pass through the injector 32, and into the wellbore 14. In other examples, the injector 32 can pull the conduit 18 to retrieve the conduit 18 from the wellbore 14. The stripper 34 can provide a pressure seal around the conduit 18 as the conduit 18 is being run into and/or pulled out of the wellbore 14. The blowout preventer 36 can seal, control, and/or monitor the wellbore 14 to prevent blowouts, or uncontrolled and/or undesired release of fluids from the wellbore 14. In other examples, different systems can be utilized based on the type of conduit 18 and/or the environment such as subsea or surface operations.

A guide arch 40 is mechanically coupled to the wellhead 30 to guide the conduit 18 from the reel 12 to the injector 32. The guide arch 40 includes a curved portion 40R that is configured to guide the conduit 18 as the conduit 18 transitions from a spooled or wound orientation along an X axis on the reel 12, to a vertical or Y axis defined by a central axis of the wellbore 14, wellhead 30, or central axis of a component 35 (e.g., pipe, lubricator, stripper, or other component having a central axis) of the wellhead 30. The curved portion 40R of the guide arch 40 thus guides the conduit 18 as the conduit 18 travels along a first direction 13 extending from the reel 12, to a second direction into or out of the wellbore 14. In some examples, a radius of the curved portion 40R may be greater than 96 inches to enable larger-diameter conduit 18 (for example, a conduit 18 having a diameter greater than 2 inches) to be used without causing excessive bending stresses on the conduit 18 due to insufficient curvature of the curved portion 40R. In at least one example, the radius of the curved portion 40R may be about 120 inches to about 160 inches. In other examples, the radius of the curved portion 40R may be about 120 inches to about 180 inches. In other examples, the radius of the curved portion 40R may not be continuous, and instead, may include a curvature having a progressive radius having more than one radius. By utilizing a curved portion 40R having a radius of about 120 inches to about 180 inches, an outer diameter 18D of the conduit 18 may be greater than 2 inches, such as a diameter 18D in a range of about 2 inches to about 5 inches. The guide arch 40 is configured to receive the conduit 18 at a first end 42 and at a second end 44, the guide arch 40 may be coupled to the injector 32. The second end 44 of the guide arch 40 may be rotatably coupled to the wellhead 30 (for example, injector 32) to enable the guide arch to rotate with respect to the injector 32, wellbore 14, wellhead 30, and/or the Y axis.

A support structure 100 is coupled to the guide arch 40 to mechanically support the guide arch 400. The support structure 100 extends from the first end 42 of the guide arch 40 and is rotatably coupled to the wellhead 30 via a swivel mount 120. The support structure 100 may include one or more arms 101. At a first end 103 of the arm 101, the arm 101 is mechanically coupled to the first end 42 of the guide arch 40. At a second end 110 of the arm 101, the arm 101 is mechanically coupled to the swivel mount 120. In at least one example, the support structure 100 may also include an actuator 106, such as a hydraulic cylinder, having an upper arm 102 extending from a first end 104 of the actuator 106, and a lower arm 108 extending from a second end 109 of the actuator 106. The actuator 106 is configured to adjust a length of the support structure 100 as measured between the first end 103 and the second end 110 of the arm 101. Such adjustment may be necessary to counter deflection of the first end 42 of the guide arch 40 that may be caused by a downward force applied by the conduit 18. In other examples, the actuator 106 may be configured to apply a force against the guide arch 40 to counteract a load applied to the guide arch 40 by the conduit 18. For example, a weight of the conduit 18 may apply excessive downward force to the first end 42 of the guide arch 40, particularly where the conduit 18 includes a larger-diameter conduit having a diameter greater than 2 inches, thereby resulting with the guide arch 40 to shift so that the reel 12 and injector 32 become misaligned. The actuator 106 may be configured to apply an upward force to the first end 42 of the guide arch 40 to counter the downward force applied by the conduit 18.

Figure 3:
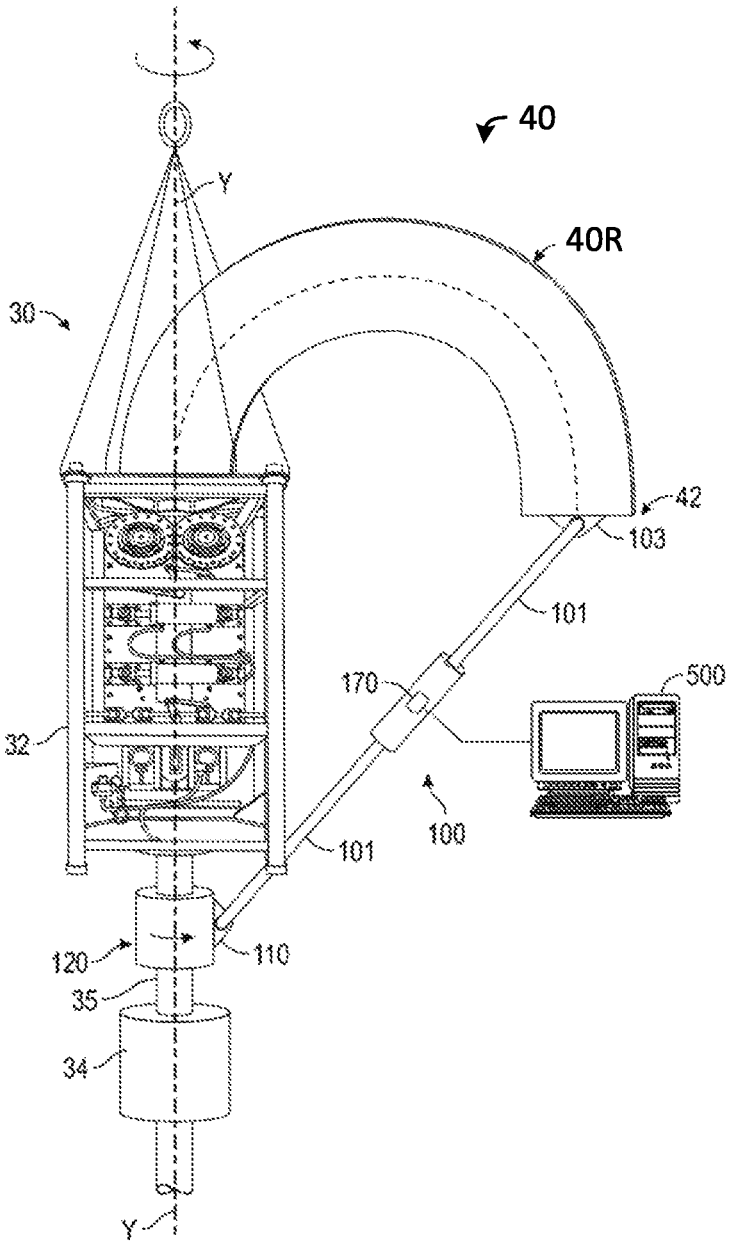
FIG. 3 is a diagram illustrating a perspective view of a guide arch, in accordance with various aspects of the subject technology.
Figure 4:
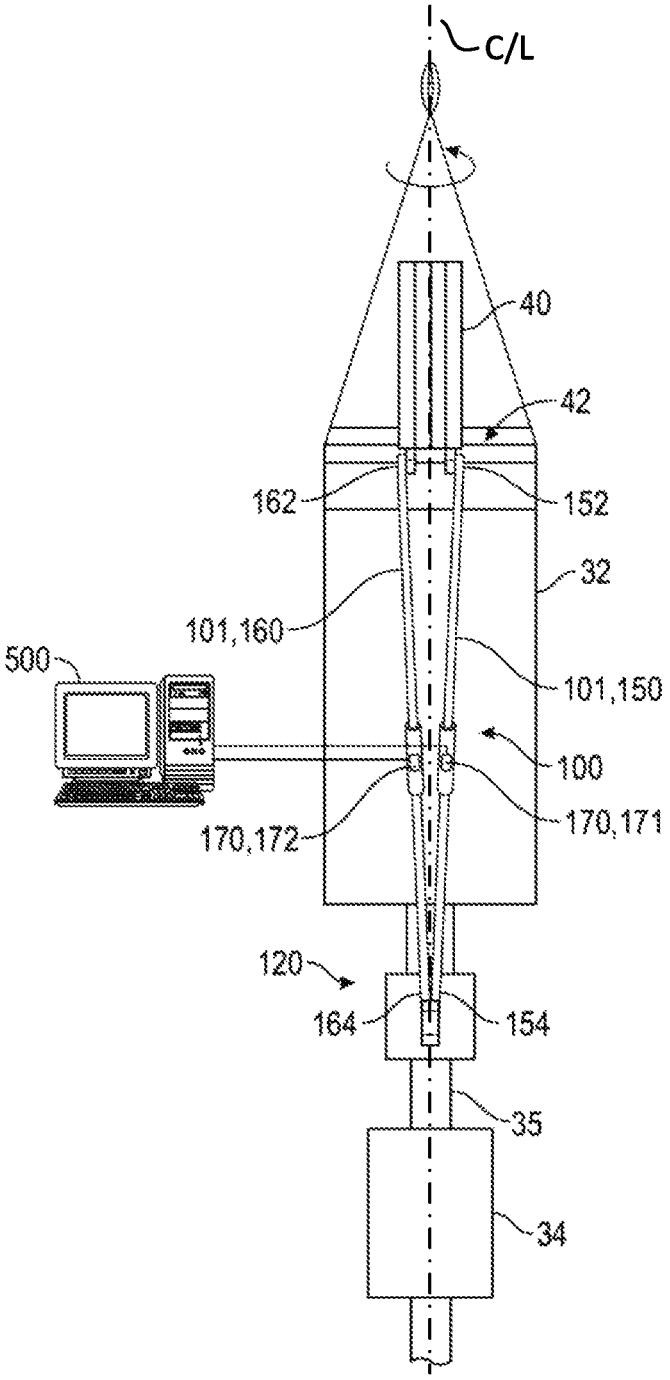
FIG. 4 is a diagram illustrating a front view of a guide arch, in accordance with various aspects of the subject technology.

The swivel mount 120 is coupled to the second end 110 of the support structure 100. The swivel mount 120 is rotatably coupled to the wellhead 30 to enable the guide arch 40 and the support structure 100 to pivot about the axis Y of the wellhead 30. In at least one example, the swivel mount 100 may include a collar that is attached to a periphery of a component 35 of the wellhead 30. In some examples, the swivel mount 100 may include a component of a lubricator. In yet other examples, the swivel mount 100 may include a flange that is configured to be clamped over an outer diameter of a component 35. The swivel mount 120 may be rotatably coupled to the wellhead 30 between the stripper 34 and the blowout preventer 36. Alternatively, the swivel mount 120 may be rotatably coupled to the wellhead 30 between the injector 32 and the stripper 34, as shown in FIGS. 3 and 4.

The swivel mount 120 is configured to allow the support structure 100 to rotate about the Y axis. In at least one example, the swivel mount 120 may be configured to allow the support structure 100 to rotate up to about 45 degrees about the Y axis. In another example, the swivel mount 120 may be configured to allow the support structure 100 to rotate up to about 90 degrees about the Y axis. In another example, the swivel mount 120 may be configured to allow the support structure 100 to rotate up to about 135 degrees about the Y axis. In another example, the swivel mount 120 may be configured to allow the support structure 100 to rotate up to about 180 degrees about the Y axis. In another example, the swivel mount 120 may be configured to allow the support structure 100 to rotate up to about 270 degrees about the Y axis. In yet another example, the swivel mount 120 may be configured to allow the support structure 100 to rotate up to about 360 degrees about the Y axis.

In some examples, the support structure 100 may further include a sensor 170 configured to measure at least one of a strain, load and force acting on the guide arch 40 and/or the arm 101. The sensor 170 may include at least one of a load cell and a strain gauge. The sensor 170 may be communicatively coupled to a controller 500 to provide data representing one of at least a strain, load and force acting on the guide arch 40 and/or the arm 101 to the controller 500. The controller 500 may be configured to receive the data from the sensor 170, process the data from the sensor 170, and determine whether to adjust a length of the actuator 106 to either lengthen or shorten a length of the arm 101, and/or to apply a force against the guide arch 40 to counter a load acting upon the guide arch 40. For example, when the sensor 170 measures a load acting upon the guide arch 40 that exceeds a predetermined threshold for deflection of the guide arch 40, the controller 500 may transmit a control signal to the actuator 106 to apply a force or load against the guide arch 40 to counter the measured load and reduce or eliminate the deflection of the guide arch caused by the conduit 18.

Figure 2:
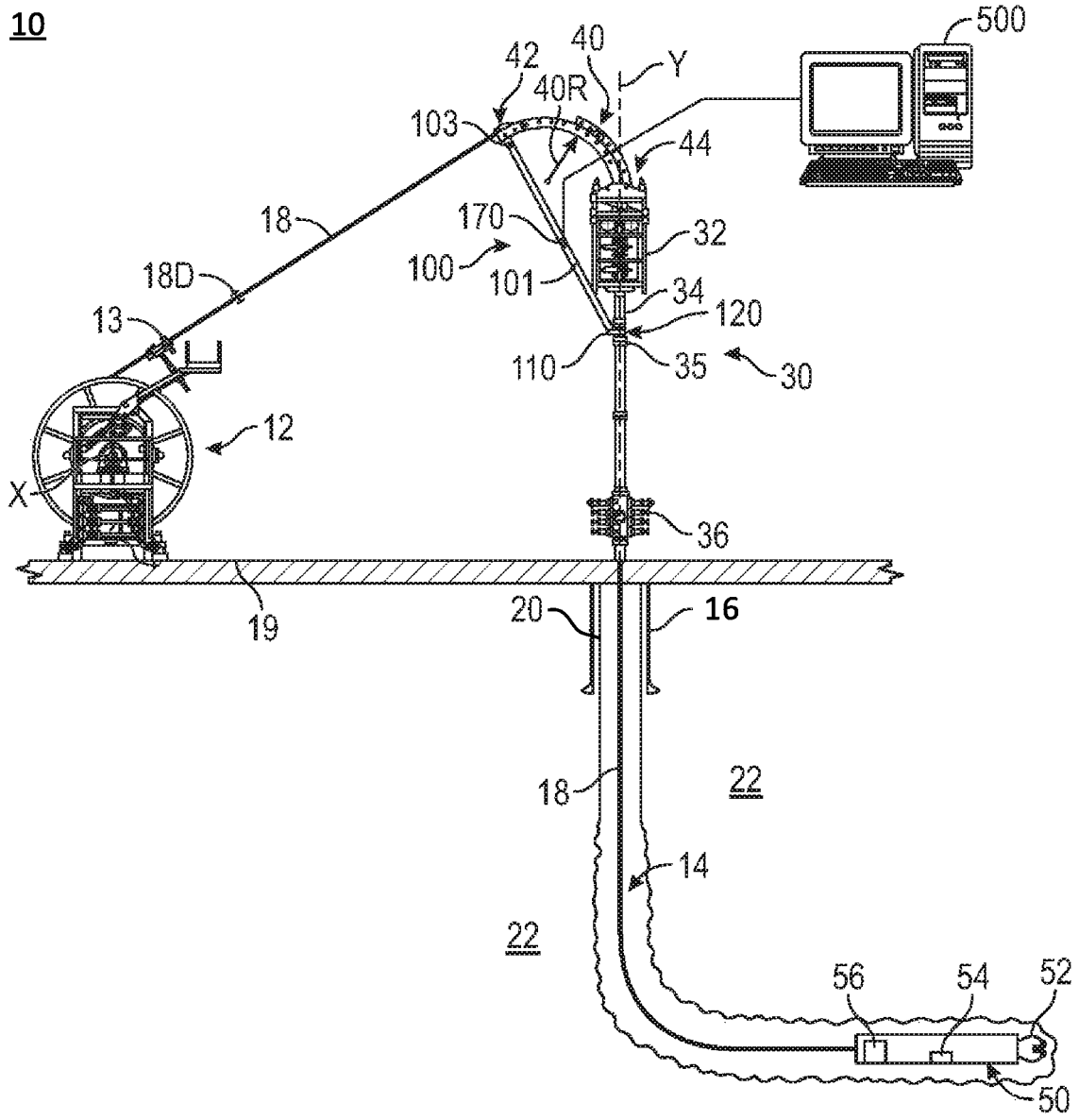
FIG. 2 is a diagram illustrating an exemplary environment for a wellhead utilizing a guide arch with a fixed support structure, in accordance with various aspects of the subject technology.

FIG. 2 is a diagram illustrating an exemplary environment 10 for a wellhead 30 utilizing a guide arch 40 with a fixed support structure 100, in accordance with various aspects of the subject technology. In at least one example, the support structure 100 may include an arm 101 having a first end 103 coupled to the guide arch 40 and a second end 110 coupled to the swivel mount 120. Disposed on the arm 101 is the sensor 170 that measures at least one of a strain, load and force acting on the arm 101. The sensor 170 may be communicatively coupled to the controller 500 to process data provided by the sensor 170 to determine whether a length of the arm 101 should be adjusted, speed of the reel 12 should be adjusted, or to otherwise adjust operations of the wellhead 30 to prevent failure or over-loading of the conduit 18 and/or guide arch 40.

As described above with reference to FIG. 1, the conduit 18 (for example, coiled tubing) is disposed in the wellbore 14. The conduit 18 is stored on the reel 12 and is guided from the reel 12 to the wellhead 30 by the guide arch 40. The guide arch 40 includes the curved portion 40R that is configured to receive the conduit 18 at the first end 42 of the guide arch 40, and guide the conduit 18 along the curved portion 40R and into the wellbore 14. To enable the guide arch 40 to pivot or rotate with respect to the wellhead 30, the guide arch 40 is rotatably coupled to the wellhead at the second end 44 of the guide arch 40. The guide arch 40 further includes the support structure 100 to mechanically support the guide arch 40. The support structure is coupled to the first end 42 of the guide arch 40 at the first end 103 of the arm 101. The guide arch 40 further includes the swivel mount 120 that is coupled to the second end 110 of the arm 101 and is rotatably coupled to the wellhead 30 to enable the guide arch 40 and support structure 100 to pivot about the Y axis of the wellhead 30.

In at least one example, the arm 101 of the support structure 100 may include a telescoping tube that is configured to have its length adjusted through use of fasteners inserted through one of a plurality of holes that are spaced apart to enable adjustment of the length of the arm 101. The arm 101 may include other profiles, such as angles, I-beams, C-channels, etc. that may be configured to have an adjustable length based on a particular arrangement of fasteners and mounting holes or slots.

FIG. 3 is a diagram illustrating a perspective view of a guide arch 40, in accordance with various aspects of the subject technology. In at least one example, the guide arch 40 may be coupled or fastened to the injector 32 such that the guide arch 40, injector 32, and support structure 100 rotate as an assembly about the Y axis via the swivel mount 120.

In at least one example, because the second end 110 of the arm 101 of the support structure 100 is attached to the wellhead 30 below the injector 32, a center of gravity of the injector 32, guide arch 40, and support structure 100 is shifted closer to the Y axis resulting in a more stabilized assembly during lifting and manipulation of the assembly via a hoist or harness. In other words, because the first end 103 of the arm 101 of the support structure 100 is coupled to the first end 42 of the guide arch 40, and the second end 110 of the arm 101 is coupled to the wellhead 30 at a location below the injector 32, a portion of a weight of the guide arch 40 is shifted to the swivel mount 120 at the second end 110 of the arm 101 to thereby shift the center of gravity of the injector 32, guide arch 40, and support structure 100 to be closer to the Y axis than would otherwise without the support structure 100.

Shifting the center of gravity of the injector 32, guide arch 40, and support structure 100 to be closer to the Y axis eases installation of the assembly onto the component 35 of the wellhead 30 because the assembly, when lifted by an overhead hoist, is better aligned with the component 35. As shown in FIG. 3, the injector 32, guide arch 40, support structure 100, and the swivel mount 120 may be installed on the component 35, above the stripper 34. In the example illustrated in FIG. 3, the swivel mount 120 is disposed between the injector 32 and the stripper 34.

FIG. 4 is a diagram illustrating a front view of a guide arch 40, in accordance with various aspects of the subject technology. In at least one example, the support structure 100 may include a first arm 150 and a second arm 160. A first end 152 of the first arm 150 is attached to the first end 42 of the guide arch 40. A first end 162 of the second arm 160 is attached to the first end 42 of the guide arch 40. A second end 154 of the first arm 150 is attached to the swivel mount 120. A second end 164 of the second arm 160 is attached to the swivel mount 120. In at least one example, the first arm 150 and the second arm 160 may form a v-shape, with a common joint at the second ends, 154 and 164 respectively. As shown, the arms 101 are arranged so that they intersect a centerline ("C/L") of the wellhead 30, injector 32, stripper 34 and/or component By mounting the second ends, 154 and 164 respectively, of the support arms 101 in the same plane as the centerline, versus mounting the support arms 101 to a corner or side of the injector frame 32, the guide arch 40 is capable of pivoting more easily while also better distributing the weight of the guide arch 40 to the centerline, instead of at an off-center point on the wellhead 30.

Each arm 101 may have a sensor 170 disposed thereon. For example, the first arm 150 may have a first sensor 171 and the second arm 160 may have a second sensor 172. The first and second sensors, 171 and 172 respectively, may be communicatively coupled to the controller 500 to provide at least one of a strain, load and force acting upon the corresponding first and second arms, 150 and 160 respectively, to the controller 500. In other examples, only one of the arms 101 may include a sensor 170.

Figure 5:
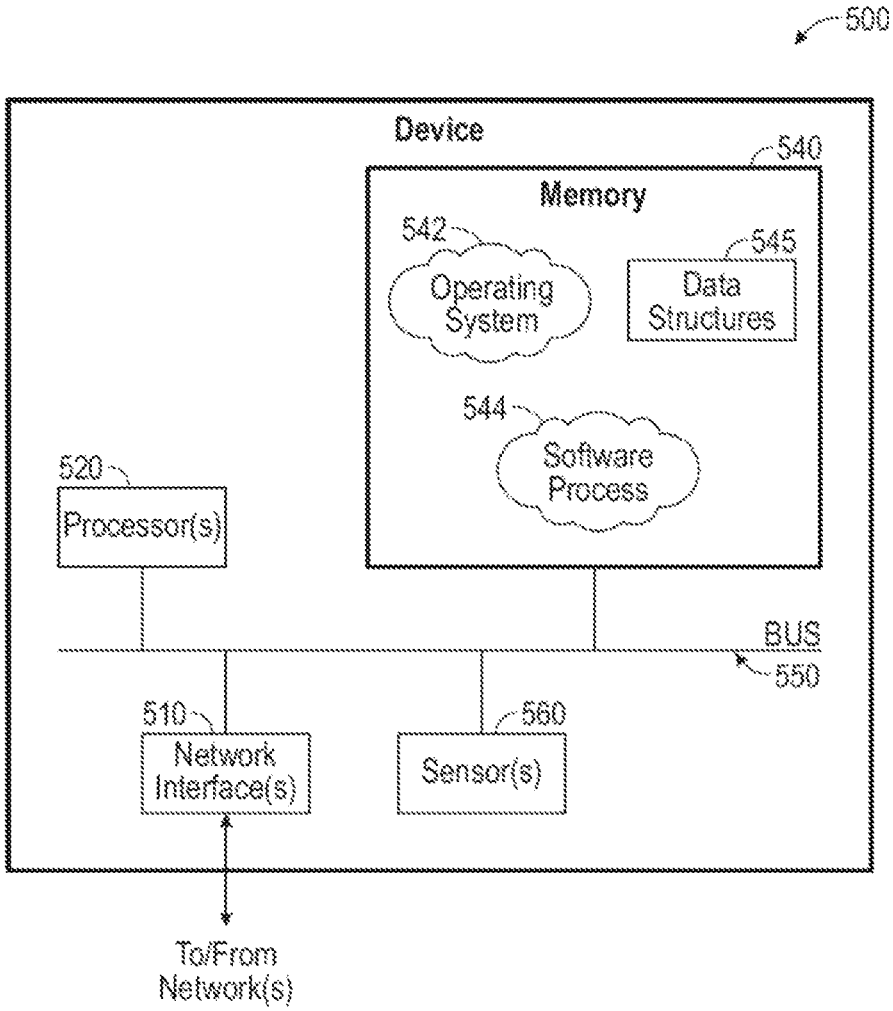
FIG. 5 illustrates an example of a controller, in accordance with various aspects of the subject technology.

FIG. 5 illustrates an example of a controller 500, in accordance with various aspects of the subject technology. Controller 500 is configured to perform processing of data and communicate with the sensor 170, for example as illustrated in FIGS. 1-4. In operation, controller 500 communicates with one or more of the above-discussed components and may also be configured to communicate with remote devices/systems.

As shown, controller 500 includes hardware and software components such as network interfaces 510, at least one processor 520, sensors 560 and a memory 540 interconnected by a system bus 550. Network interface(s) 510 can include mechanical, electrical, and signaling circuitry for communicating data over communication links, which may include wired or wireless communication links. Network interfaces 510 are configured to transmit and/or receive data using a variety of different communication protocols, as will be understood by those skilled in the art.

Processor 520 represents a digital signal processor (e.g., a microprocessor, a microcontroller, or a fixed-logic processor, etc.) configured to execute instructions or logic to perform tasks in a wellbore environment. Processor 520 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 520 typically operates in conjunction with shared or dedicated hardware, including but not limited to, hardware capable of executing software and hardware. For example, processor 520 may include elements or logic adapted to execute software programs and manipulate data structures 545, which may reside in memory 540.

Sensors 560, which may include sensor 170 as disclosed herein, typically operate in conjunction with processor 520 to perform measurements, and can include special-purpose processors, detectors, transmitters, receivers, and the like. In this fashion, sensors 560 may include hardware/software for generating, transmitting, receiving, detection, logging, and/or sampling magnetic fields, seismic activity, and/or acoustic waves, temperature, pressure, radiation levels, casing collar locations, weights, torques, tool health (such as voltage levels and current monitors), accelerations, gravitational fields, strains, video recordings, flow rates, solids concentration, solids size, chemical composition, and/or other parameters.

Memory 540 comprises a plurality of storage locations that are addressable by processor 520 for storing software programs and data structures 545 associated with the embodiments described herein. An operating system 542, portions of which may be typically resident in memory 540 and executed by processor 520, functionally organizes the device by, inter alia, invoking operations in support of software processes and/or services 544 executing on controller 500. These software processes and/or services 544 may perform processing of data and communication with controller 500, as described herein. Note that while process/service 544 is shown in centralized memory 540, some examples provide for these processes/services to be operated in a distributed computing network.

It will be apparent to those skilled in the art that other processor and memory types, including various computer-readable media, may be used to store and execute program instructions pertaining to the fluidic channel evaluation techniques described herein. Also, while the description illustrates various processes, it is expressly contemplated that various processes may be embodied as modules having portions of the process/service 544 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 520 or computer readable medium encoded with instructions for execution by processor 520 that, when executed by the processor, are operable to cause the processor to perform the functions described herein.

Figure 6:
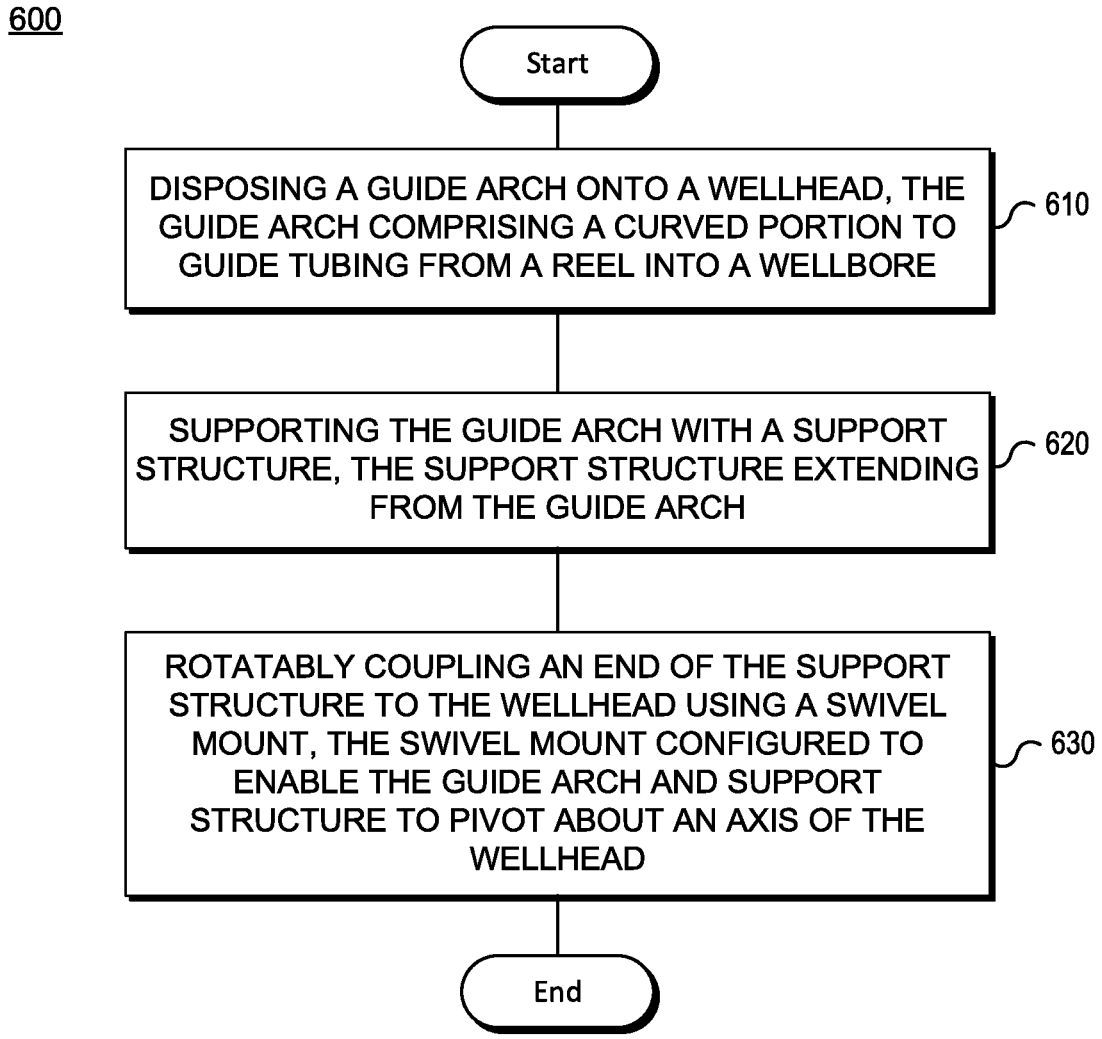
FIG. 6 is an example method for supporting tubing of a wellhead using a pivoting guide arch, in accordance with various aspects of the subject technology.

FIG. 6 is an example method 600 for supporting tubing of a wellhead using a pivoting guide arch, in accordance with various aspects of the subject technology. The method 600 is provided by way of example, as there are a variety of ways to carry out the method. The method 600 described below can be carried out using the configurations illustrated in FIGS. 1-5, for example, and various elements of these figures are referenced in explaining example method 600. Each block shown in FIG. 6 represents one or more processes, methods or subroutines, carried out in the example method 600. Furthermore, the illustrated order of blocks is illustrative only and the order of the blocks can change according to the present disclosure. Additional blocks may be added or fewer blocks may be utilized, without departing from this disclosure. The method 600 can begin at block 610.

At block 610, a guide arch is disposed onto a wellhead. The guide arch includes a curved portion to guide tubing from a reel into a wellbore. At block 620, the guide arch is supported with a support structure. The support structure extends from the guide arch to the wellhead so that the guide arch is mechanically supported by an arm extending from a first end of the guide arch to a point on the wellhead that is below an injector. The injector is configured to move the tubing into and out of the wellbore. At block 630, an end of the support structure is rotatably coupled to the wellhead using a swivel mount. The swivel mount enables the guide arch and support structure to pivot about an axis of the wellhead. The axis may be a center axis of the wellhead, wellbore, or a component of the wellheads, such as a pipe, lubricator, injector, or other component having an opening through which fluid flows.

The method may also include measuring at least one of a strain, load and force using a sensor disposed on the support structure. The sensor may be communicatively coupled to a controller to provide data representing at least one of a strain, load and force acting on the support structure, to the controller. In response, the controller may be configured to process the data and determine that an actuator of the support structure requires adjustment. For example, if the sensor detects a load that exceeds a predetermined amount indicative of deflection that is outside a predetermined range, the controller may send a signal to cause the actuator to apply a force or load against the guide arch to counter the load being applied to the guide arch so that continual deflection of the guide arch is minimized, prevented, or reversed. In another example, data from the sensor representing strain on the guide arch may be utilized by the controller to inform an operator that the guide arch may be overloaded, thereby enabling the operator to take actions to reduce the load on the guide arch, by for example, moving the injector with respect to the reel.

As described above, the swivel mount enables the guide arch and injector to pivot about the axis so that the guide arch may self-align to the reel storing the tubing. As the tubing is unreeled from the reel, a side to side motion of the tubing as the tubing tracks along the reel causes the guide arch and injector to pivot about the swivel mount to reduce or eliminate a side load acting on the guide arch. In other words, the swivel mount enables the guide arch to maintain a more direct angle of approach over conventional guide arches that are not capable of pivoting. By reducing the side load on the tubing, wear on the tubing is reduced or minimized thereby extending the lifespan or longevity of the tubing. In another example, by allowing the guide arch and injector to pivot about the axis, the likelihood of the tubing slipping off of the guide arch is also minimized or eliminated because the guide arch is capable of self-aligning with the tubing as the tubing tracks from side to side along the reel.

In yet another example, the swivel mount enables the injector and the guide arch to pivot about the Y axis to align with a different reel when necessary, without requiring movement of the reel. Alignment of the injector and guide arch with respect to a particular reel is handled by the swivel mount, in that the injector and the guide arch can be rotated as a unit, toward the desired reel without having to move the reel into alignment with the injector.

In some examples, the support structure is configured to mechanically support the guide arch so that the guide arch is capable of handling larger-diameter tubing, such as tubing having an outside diameter exceeding 2 inches. By transferring a load acting upon the first end of the guide arch to another portion of the wellhead (e.g., to a section of the wellhead in contact with the swivel mount), a load capacity of the guide arch is increased. In yet another example, because the support structure connects the first end of the guide arch to a portion of the wellhead below the injector, a center of gravity of the guide arch, injector and support structure is shifted to be closer to the axis, thereby making lifting and handling of the assembly easier when lifted overhead, such as during installation or removal of the assembly from the wellhead.

Numerous examples are provided herein to enhance understanding of the present disclosure. A specific set of statements are provided as follows.

Statement 1: A pivoting guide arch comprising: a guide including a curved portion, the guide receiving a coiled tubing at a first end, and guiding the coiled tubing along the curved portion to change a direction of the coiled tubing; a support structure extending from the first end of the guide and mechanically supporting the guide; and a swivel mount coupled to an end of the support structure, the swivel mount rotatably coupled to a wellhead to enable the guide and support structure to pivot about an axis of the wellhead.

Statement 2: A pivoting guide arch is disclosed according to Statement 1, wherein a second end of the guide is rotatably coupled to the wellhead such that the guide pivots about the axis of the wellhead.

Statement 3: A pivoting guide arch is disclosed according to Statements 1 or 2, wherein the support structure includes a first arm and a second arm, the first and second arms forming a v-shape.

Statement 4: A pivoting guide arch is disclosed according to any of preceding Statements 1-3, wherein the support structure includes an actuator to adjust a length of the support structure.

Statement 5: A pivoting guide arch is disclosed according to any of preceding Statements 1-4, wherein the support structure includes an actuator to apply a force against the guide to counteract a load applied to the guide.

Statement 6: A pivoting guide arch is disclosed according to any of preceding Statements 1-5, wherein the support structure includes a sensor to measure at least one of a strain, load, and force.

Statement 7: A pivoting guide arch is disclosed according to any of preceding Statements 1-6, wherein the sensor includes at least one of a load cell and a strain gauge.

Statement 8: A pivoting guide arch is disclosed according to any of preceding Statements 1-7, wherein the sensor is communicatively coupled to a controller, the controller adjusting the actuator based on data supplied by the sensor.

Statement 9: A wellhead system is disclosed comprising: a coiled tube configured to be disposed in a wellbore; a reel storing the coiled tube; a guide arch including a curved portion, the guide arch receiving the coiled tube at a first end, and guiding the tube along the curved portion and into the wellbore, the guide arch rotatably coupled to a wellhead at a second end; a support structure extending from the first end of the guide arch and mechanically supporting the guide arch; and a swivel mount coupled to an end of the support structure, the swivel mount rotatably coupled to the wellhead to enable the guide arch and support structure to pivot about an axis of the wellhead.

Statement 10: A wellhead system is disclosed according to Statement 9, wherein the support structure includes an actuator to adjust a length of the support structure.

Statement 11: A wellhead system is disclosed according to Statements 9 or 10, wherein the support structure includes an actuator to apply a force against the guide arch to counteract a load applied to the guide arch.

Statement 12: A wellhead system is disclosed according to any of preceding Statements 9-11, wherein the support structure includes a sensor to measure at least one of a strain, load, and force.

Statement 13: A wellhead system is disclosed according to any of preceding Statements 9-12, wherein the sensor is communicatively coupled to a controller, the controller adjusting the actuator based on data supplied by the sensor.

Statement 14: A wellhead system is disclosed according to any of preceding Statements 9-13, wherein the wellhead includes an injector, a stripper disposed below the injector, and a blowout preventer disposed below the stripper; wherein the swivel mount is rotatably coupled to the wellhead between the stripper and the blowout preventer.

Statement 15: A wellhead system is disclosed according to any of preceding Statements 9-14, wherein the wellhead comprises an injector, a stripper disposed below the injector, and a blowout preventer disposed below the stripper; wherein the swivel mount is rotatably coupled to the wellhead between the injector and the stripper.

Statement 16: A wellhead system is disclosed according to any of preceding Statements 9-15, wherein the coiled tube has an outer diameter in a range of about 2 inches to about 5 inches Statement 17: A wellhead system is disclosed according to any of preceding Statements 9-16, wherein the curved portion of the guide arch has a radius in a range of about 120 inches to about 180 inches.

Statement 18: A method for supporting tubing of a wellhead using a pivoting guide arch is disclosed comprising: disposing a guide arch onto a wellhead, the guide arch including a curved portion to guide tubing from a reel into a wellbore; supporting the guide arch with a support structure, the support structure extending from the guide arch; and rotatably coupling an end of the support structure to the wellhead using a swivel mount, the swivel mount enabling the guide arch and support structure to pivot about an axis of the wellhead.

Statement 19: A method is disclosed according to Statement 18, further comprising: measuring, by a sensor disposed on the support structure, at least one of a strain, load, and force.

Statement 20: A method is disclosed according to Statements 18 or 19, further comprising: adjusting an actuator of the support structure based on data supplied by the sensor.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. A pivoting guide arch comprising:

a guide including a curved portion, the guide receiving a coiled tubing at a first end, and guiding the coiled tubing along the curved portion to change a direction of the coiled tubing;

a support structure extending from the first end of the guide and mechanically supporting the guide; and a swivel mount coupled to an end of the support structure, the swivel mount rotatably coupled to a wellhead to enable the guide and the support structure to pivot about an axis of the wellhead, wherein the swivel mount is detached from an injector and positioned below the injector.

2. The pivoting guide arch of claim 1, wherein a second end of the guide is rotatably coupled to the wellhead such that the guide pivots about the axis of the wellhead.

3. The pivoting guide arch of claim 1, wherein the support structure includes a first arm and a second arm, the first and second arms forming a v-shape.

4. The pivoting guide arch of claim 1, wherein the support structure includes an actuator to adjust a length of the support structure.

5. The pivoting guide arch of claim 1, wherein the support structure includes an actuator to apply a force against the guide to counteract a load applied to the guide.

6. The pivoting guide arch of claim 5, wherein the support structure includes a sensor to measure at least one of a strain, load, and force.

7. The pivoting guide arch of claim 6, wherein the sensor includes at least one of a load cell and a strain gauge.

8. The pivoting guide arch of claim 6, wherein the sensor is communicatively coupled to a controller, the controller adjusting the actuator based on data supplied by the sensor.

9. A wellhead system comprising:

a coiled tube configured to be disposed in a wellbore;

a reel storing the coiled tube;

a guide arch including a curved portion, the guide arch receiving the coiled tube at a first end, and guiding the tube along the curved portion and into the wellbore, the guide arch rotatably coupled to a wellhead at a second end;

a support structure extending from the first end of the guide arch and mechanically supporting the guide arch; and a swivel mount coupled to an end of the support structure, the swivel mount rotatably coupled to the wellhead to enable the guide arch and support structure to pivot about an axis of the wellhead, wherein the swivel mount is detached from an injector and positioned below the injector.

10. The wellhead system of claim 9, wherein the support structure includes an actuator to adjust a length of the support structure.

11. The wellhead system of claim 9, wherein the support structure includes an actuator to apply a force against the guide arch to counteract a load applied to the guide arch.

12. The wellhead system of claim 11, wherein the support structure includes a sensor to measure at least one of a strain, load, and force.

13. The wellhead system of claim 12, wherein the sensor is communicatively coupled to a controller, the controller adjusting the actuator based on data supplied by the sensor.

14. The wellhead system of claim 9, wherein the wellhead includes the injector, a stripper disposed below the injector, and a blowout preventer disposed below the stripper; wherein the swivel mount is rotatably coupled to the wellhead between the stripper and the blowout preventer.

15. The wellhead system of claim 9, wherein the wellhead includes the injector, a stripper disposed below the injector, and a blowout preventer disposed below the stripper; wherein the swivel mount is rotatably coupled to the wellhead between the injector and the stripper.

16. The wellhead system of claim 9, wherein the coiled tube has an outer diameter in a range of about 2 inches to about 5 inches.

17. The wellhead system of claim 9, wherein the curved portion of the guide arch has a radius in a range of about 120 inches to about 180 inches.

18. A method to support tubing of a wellhead using a pivoting guide arch, the method comprising:

disposing a guide arch onto a wellhead, the guide arch including a curved portion to guide tubing from a reel into a wellbore;

supporting the guide arch with a support structure, the support structure extending from the guide arch; and rotatably coupling an end of the support structure to the wellhead using a swivel mount, the swivel mount enabling the guide arch and support structure to pivot about an axis of the wellhead, wherein the swivel mount is detached from an injector and positioned below the injector.

19. The method of claim 18, further comprising: measuring, by a sensor disposed on the support structure, at least one of a strain, load, and force.

20. The method of claim 19, further comprising: adjusting an actuator of the support structure based on data supplied by the sensor.

* * * * *